US005593280A

United States Patent [19]

Takada et al.

[11] Patent Number: 5,593,280

[45] Date of Patent: Jan. 14, 1997

[54] PROPELLER FOR BOAT

[75] Inventors: Hideaki Takada; Takao Aihara; Ikuo Nakazato, all of Wako, Japan

[73] Assignee: Honda Giken Kogyo Kabushiki Kaisha, Tokyo, Japan

[21] Appl. No.: 545,532

[22] Filed: Oct. 19, 1995

[30] Foreign Application Priority Data

Oct. 20, 1994 [JP] Japan ..... 6-255014
Oct. 6, 1995 [JP] Japan ..... 7-260264

[51] Int. Cl.[6] ..... B63H 1/24; B63H 3/00

[52] U.S. Cl. ..... 416/44; 416/87; 416/93 A; 416/137; 416/203

[58] Field of Search ..... 416/44, 87, 89, 416/93 A, 134 R, 136, 137, 175, 203

[56] References Cited

U.S. PATENT DOCUMENTS 5,466,177 11/1995 Aihara et al. ..... 416/89
5,494,406 2/1996 Takada et al. ..... 416/87

FOREIGN PATENT DOCUMENTS 2413199 10/1974 Germany ..... 416/124
2-144287 6/1990 Japan .

*Primary Examiner*—James Larson
*Attorney, Agent, or Firm*—Nikaido, Marmelstein, Murray & Oram LLP

[57] ABSTRACT

In a propeller for a boat, a plurality of stationary blades and a plurality of variable blades are alternately disposed around an outer periphery of a propeller boss. Exhaust passages are formed in the propeller boss to axially pass through the propeller boss at location corresponding to the stationary blades. Despite the provision of the variable blade which is variable in diameter or pitch, the exhaust passage can be formed into a large sectional area in the blade boss without being obstructed by a blade shaft for the variable blade.

7 Claims, 11 Drawing Sheets

PROPELLER FOR BOAT

BACKGROUND OF THE INVENTION

1. Field of the Invention

The present invention relates to a propeller for a boat, including a variable-diameter blade or variable-pitch blade mounted to a propeller boss connected to a propeller shaft, and an exhaust passage defined in the propeller boss for discharging an exhaust gas from an engine.

2. Description of the Prior Art

The boat propellers conventionally known include a stationary blade type having all of blades integrally formed on the propeller boss, and a variable blade type having all of blades pivotally supported such that their pitches or propeller diameter can be variable (for example, see Japanese Patent Application Laid-open No. 144287/90). In the propeller, it is also known that the exhaust passage is defined in the propeller boss to extend axially through the propeller boss in order to discharge the exhaust gas from the engine driving the propeller into water by utilizing the propeller.

When the exhaust passage is formed in the propeller boss, a sufficiently large sectional area of the exhaust passage can be insured in the propeller of the stationary blade type without any obstruction by the blades. In the propeller of the variable blade type, however, the exhaust passage is interfered by the blade shaft supporting the variable blades or the like and necessarily constricted, resulting in an increased resistance to the exhaust gas and a reduced output from the engine.

Accordingly, it is an object of the present invention to provide a propeller for a boat, wherein the variable-diameter blade or the variable-pitch blade are provided on propeller boss, but an exhaust passage of a large passage area can be formed in the propeller boss.

SUMMARY OF THE INVENTION

To achieve the above object, according to a first aspect and feature of the present invention, there is provided a propeller for a boat, comprising: a propeller boss connected to a propeller shaft; a stationary blade integrally formed on the propeller boss; a variable blade pivotally supported on the propeller boss through a blade shaft, such that a diameter or pitch of the variable blade is increased in accordance with an increase in the number of rotation of the propeller; and an exhaust passage for an engine exhaust gas provided in the propeller boss to axially pass through the boss at a location corresponding to the stationary blade.

According to a second aspect and feature of the present invention, in addition to the first feature, the variable blade is openably and closably supported on the propeller boss through the blade shaft, such that the propeller diameter is increased and decreased in accordance with an increase and a decrease in centrifugal force.

According to a third aspect and feature of the present invention, in addition to the first or second feature, the maximum propeller diameter of the variable blade is set substantially equal to the propeller diameter of the stationary blade.

According to a fourth aspect and feature of the present invention, in addition to the second or third feature, the variable blade is formed such that when the variable blade is closed into a minimum propeller diameter position, at least a portion of the variable blade is superposed on the stationary blade.

According to a fifth aspect and feature of the present invention, in addition to the first feature, the maximum pitch of the variable blade which is variable in pitch and the pitch of the stationary blade are substantially equal to each other.

According to a sixth aspect and feature of the present invention, in addition to the first or fifth feature, the variable blade is formed such that the center of a resisting force of water generated during normal rotation of the propeller is offset from the center of the blade shaft forwardly in an axial direction of the propeller shaft by a predetermined distance, and the propeller further includes a return spring connected to the variable blade for biasing the variable blade in a pitch decreasing direction.

Further, according to a sixth aspect and feature of the present invention, in addition to one of the first to sixth features, a plurality of the variable blades are pivotally supported on the propeller boss and operatively associated with one another through a synchronizer in order to synchronize the changes in their propeller diameters or pitches.

With the first feature of the present invention, despite the provision of the variable-diameter blade or the variable-pitch blade, the exhaust passage can be formed into a large sectional area in the propeller boss without an obstruction by the blade shaft supporting the variable-diameter blade or the variable-pitch blade, thereby decreasing the resistance to the exhaust gas from the engine to contribute to an enhancement in engine output.

With the second feature of the present invention, in a low-speed rotation range for the propeller, the variable blade is closed, such that the total propeller efficiency of the stationary and variable blades can be reduced, resulting in a reduction in speed of change in thrust force with a change in rotational speed of the propeller, thus satisfying a low-speed operability. In a high-speed rotation range for the propeller, the variable blade is opened, such that the total propeller efficiency of the stationary and variable blades can be increased to the maximum, thus satisfying a high output performance.

In addition, only some of the blades are formed into a variable-diameter type controlled by a centrifugal force and for this reason, an actuator for such control is not required, leading to a simplification in structure and a reduction in size of the propeller boss.

With the third feature of the present invention, in the high-speed rotation range for the propeller, both the stationary and variable blades can exhibit substantially equivalent performances, thereby avoiding the interference of the performances to effectively enhance the total propeller efficiency to provide a further good high output performance.

With the fourth feature of the present invention, in the low-speed rotation range for the propeller, the performances of the stationary and variable blades are interfered with each other to effective reduce the total propeller efficiency, thereby making it possible to further enhance the low-speed operability.

With the fifth feature of the present invention, when the variable blade reaches the maximum pitch position, pitches of all the blades are equalized, such that the interference of the performances does not occur. Thus, it is possible to effectively enhance the total thrust force. Further, with the sixth feature of the present invention, it is possible to automatically control the pitch of the variable blade in accordance with the rotational speed by an extremely simple structure.

Yet further, with the seventh feature of the present invention, it is possible to eliminate the variation in propeller diameter or pitch of the variable blades to stabilize the propeller performance.

The above and other objects, features and advantages of the invention will become apparent from preferred embodiments taken in conjunction with the accompanying drawings.

DESCRIPTION OF THE PREFERRED EMBODIMENTS

A first embodiment of the present invention will now be described with reference to FIGS. 1 to 5.

Figure 1:
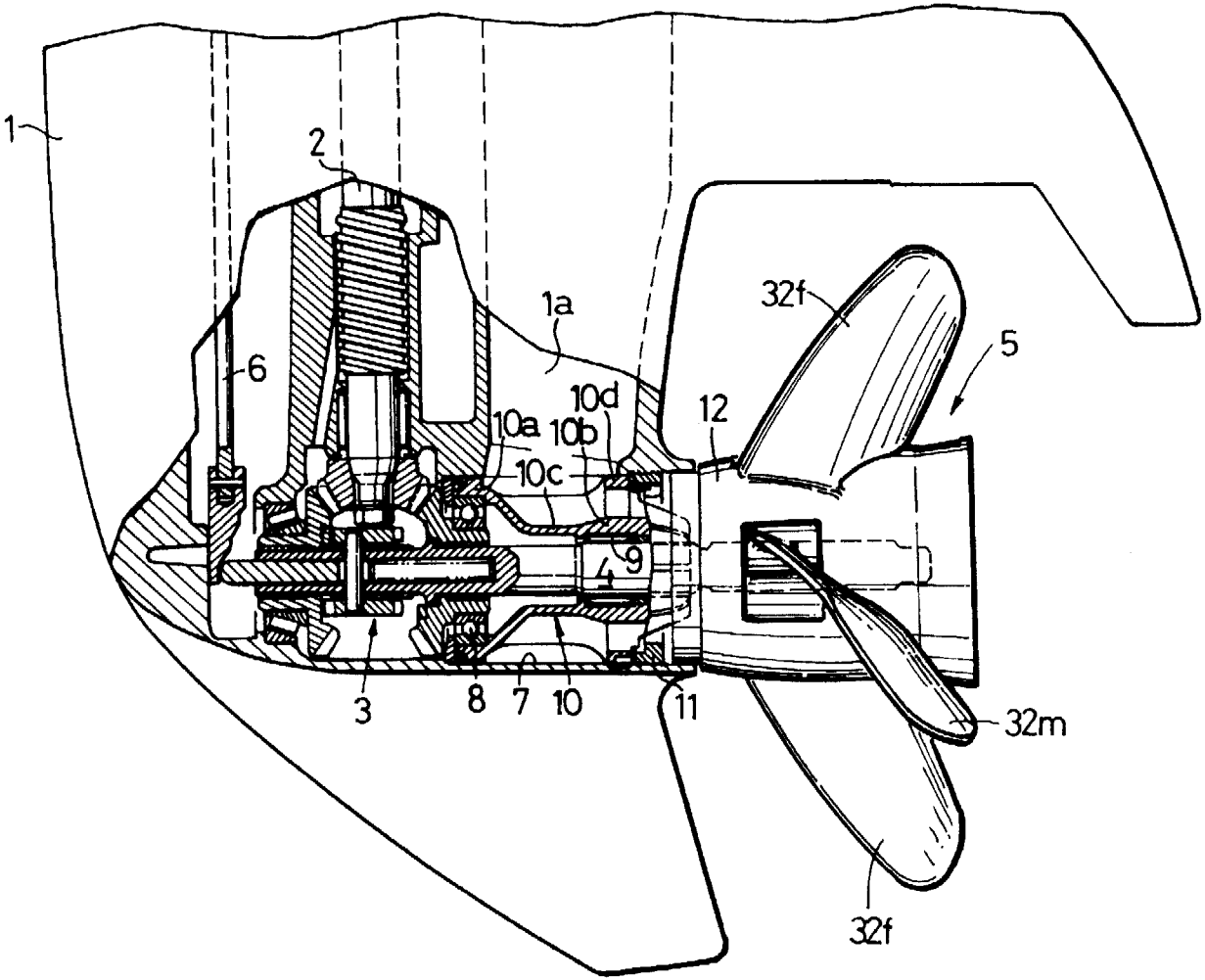
FIG. 1 is a partially vertical sectional side view of an essential portion of a propeller assembly including a propeller according to a first embodiment of the present invention.

Referring first to FIG. 1, a propeller assembly body 1 of an outboard engine system is mounted on a transom of a boat. A driving shaft 2 which is vertically disposed and driven from an engine (not shown), and a propeller shaft 4 which is horizontally disposed and connected to the driving shaft 2 through a forward and backward gear mechanism 3 are carried in the propeller assembly body 1. A propeller 5 of the present invention is mounted on that portion of the propeller shaft 4 which protrudes rearwardly from the propeller assembly body 1.

The forward and backward gear mechanism 3 is of a known bevel gear type and is switchable between a forward mode in which the propeller shaft 4 can be driven from the driving shaft 2 in a forward direction, and a backward mode in which the propeller shaft 4 can be driven in a backward direction, by lifting and lowering of a switching rod 6 parallel to the driving shaft 2.

Figure 2:
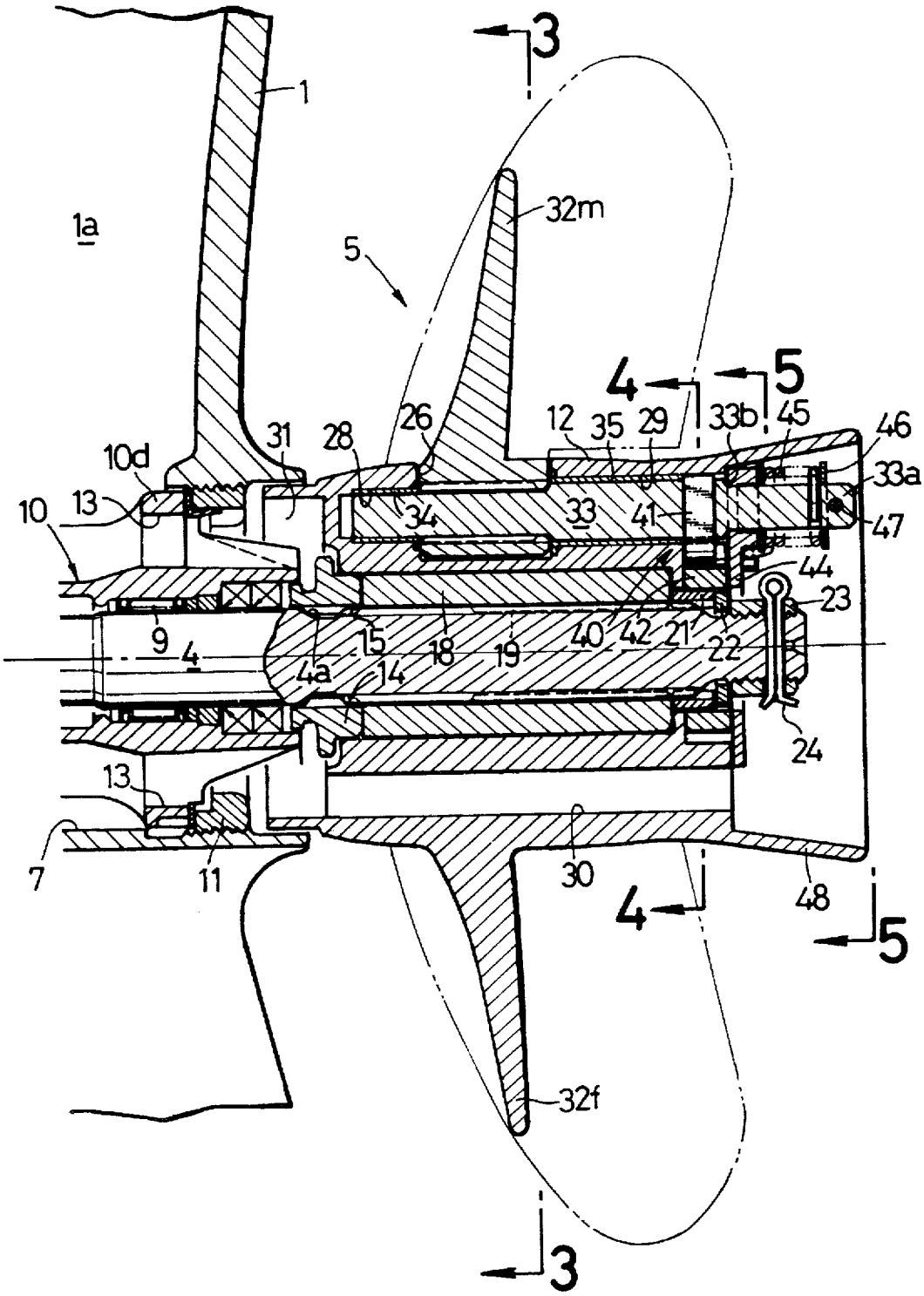
FIG. 2 is an enlarged vertical sectional view (taken along a line 2—2 in FIG. 3) of the essential portion shown in FIG. 1.

Referring to FIGS. 1 and 2, a bearing holder 10 for holding a pair of front and rear bearings 8 and 9 for bearing the propeller shaft 4 is fitted in a mounting hole 7 which opens into a rear surface of the propeller assembly body 1, and a ring nut 11 is threadedly fitted in the mounted hole 7 for retaining the bearing holder 10 from the rearward. The bearing holder 10 includes a larger-diameter sleeve 10*a* for holding the front ball bearing 8, and a smaller-diameter sleeve 10*b* for holding the rear needle bearing 9. Both the sleeves 10*a* and 10*b* are integrally connected to each other through a tapered sleeve 10*c*. The smaller-diameter sleeve 10*b* is integrally provided with a flange 10*d* which protrudes from an outer peripheral surface of the smaller-diameter sleeve 10*b* and which is retained by the ring nut 11. The flange 10*d* has a plurality of exhaust outlets 13 provided therein to communicate with an exhaust port in the engine through a hollow 1*a* in the propeller assembly body 1.

The arrangement of the propeller 5 will be described with reference to FIGS. 2 to 5.

Referring to FIG. 2, a thrust ring 14 is fitted over the propeller shaft 4 adjacent a rear end of the bearing holder 10 through a spline 15. The thrust ring 14 is prevented from being moved forwardly by abutment against a tapered surface 4*a* of the propeller shaft 4.

In back of the thrust ring 14, a sleeve 18 made of a metal or a synthetic resin which constitutes a torque limiting means is releasably fitted over the propeller shaft 4 through a spline 19, and a propeller boss 12 is press-fitted to the sleeve 18 with a predetermined load. In this manner, the sleeve 18 is connected to the propeller boss 12 with a predetermined frictional force, but when the sleeve 18 undergoes a rotative torque of a predetermined value or more, a slipping is produced between the sleeve 18 and the propeller boss 12.

A smaller-diameter collar 21 is spline-fitted over the propeller shaft 4 to abut against a rear end of the sleeve 18, and a nut 23 is threadedly mounted on a rear end of the propeller shaft 4 for retaining a rear end of the extended collar 21 through a thrust washer 22. A locking split pin 24 is inserted into the nut 23 and the propeller shaft 4. The extended collar 21 may be integral with the sleeve 18.

Figure 3:
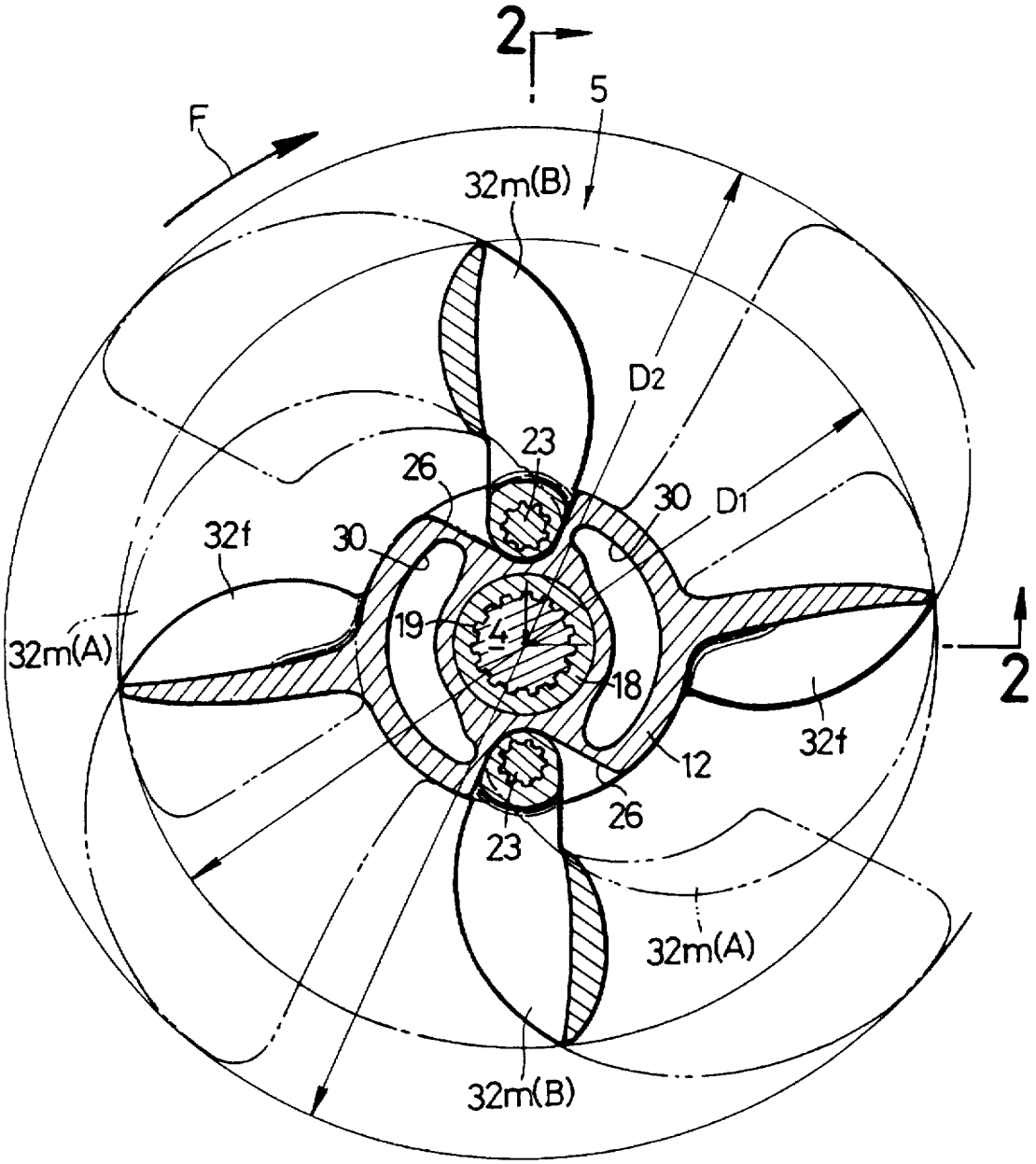
FIG. 3 is a sectional view taken along a line 3—3 in FIG. 2.

Referring to FIGS. 2 and 3, stationary blades 32*f* and variable blades 32*m* are provided on the propeller boss 12 and arranged on a diametrical line of the propeller boss 12 to form a pair, respectively. The stationary blades 32*f* are integrally formed on the propeller boss 12, and the variable blades 32*m* are pivotally supported on the propeller boss 12 through blade shafts 33, as described below, such that the propeller diameter can be varied.

Provided in the propeller boss 12 are a pair of recesses 26 which open into an outer peripheral surface of the boss 12 between the pair of stationary blades 32*f* and whose bottom surfaces are in proximity to an outer peripheral surface of the sleeve 18, a pair of bearing holes 28 and 29 which open into longitudinally opposite end walls of the recesses 26, a pair of exhaust passages 30 axially passed through the propeller boss 12 at locations corresponding to the stationary blades 32*f*, and an annular exhaust gas-distribution chamber 31 which permits the exhaust passages 30 to communicate with the exhaust outlet 13 at a front end of the boss body.

A boss of the variable blade 32*m* is accommodated in each of the recesses 26 of the propeller boss 12, and longitudinally opposite ends of the blade shaft 33 spline-fitted in the boss are rotatably carried in the bearing holes 28 and 29 with bushes 34 and 35 made of a synthetic resin interposed therebetween.

Each of the variable blades 32*m* is turned along with the blade shaft 33 between a closed position A in which the propeller diameter assumes a minimum value $D_1$, and an opened position B in which the propeller diameter assumes a maximum value $D_2$. The maximum propeller diameter $D_2$ is set at a value substantially equal to the diameter of the stationary blade 32*f*, and at the closed position A, at least a rear edge portion of the variable blade 32*m* is superposed on a front edge portion of the stationary blade 32*f*. The closed and opened positions A and B are defined by the abutment of the variable blade 32*m* against inner walls of the recess 26.

Figure 4:
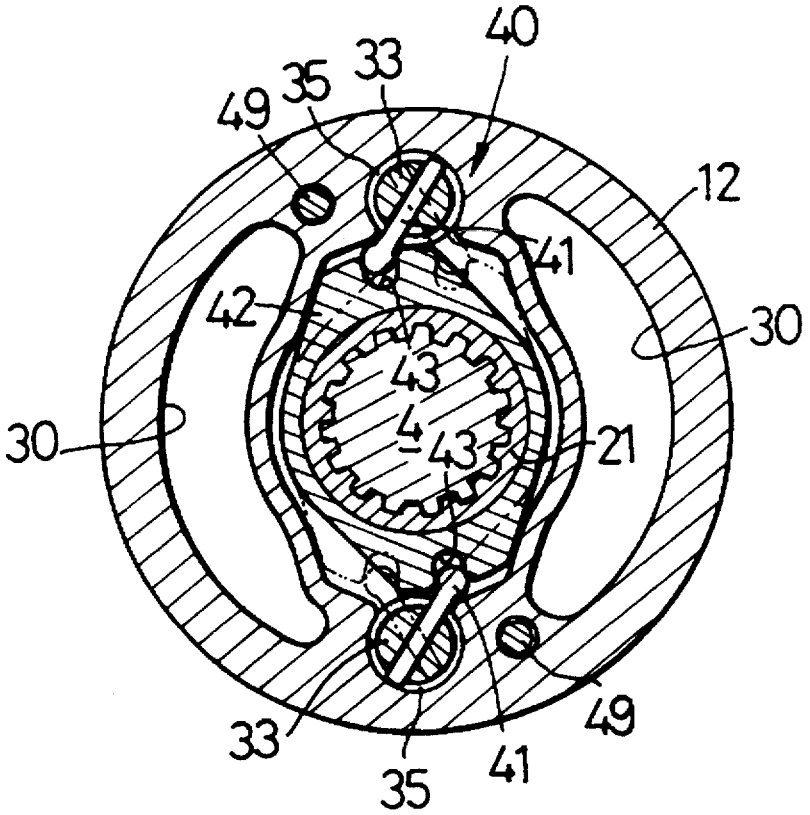
FIG. 4 is a sectional view taken along a line 4—4 in FIG. 2.
Figure 5:
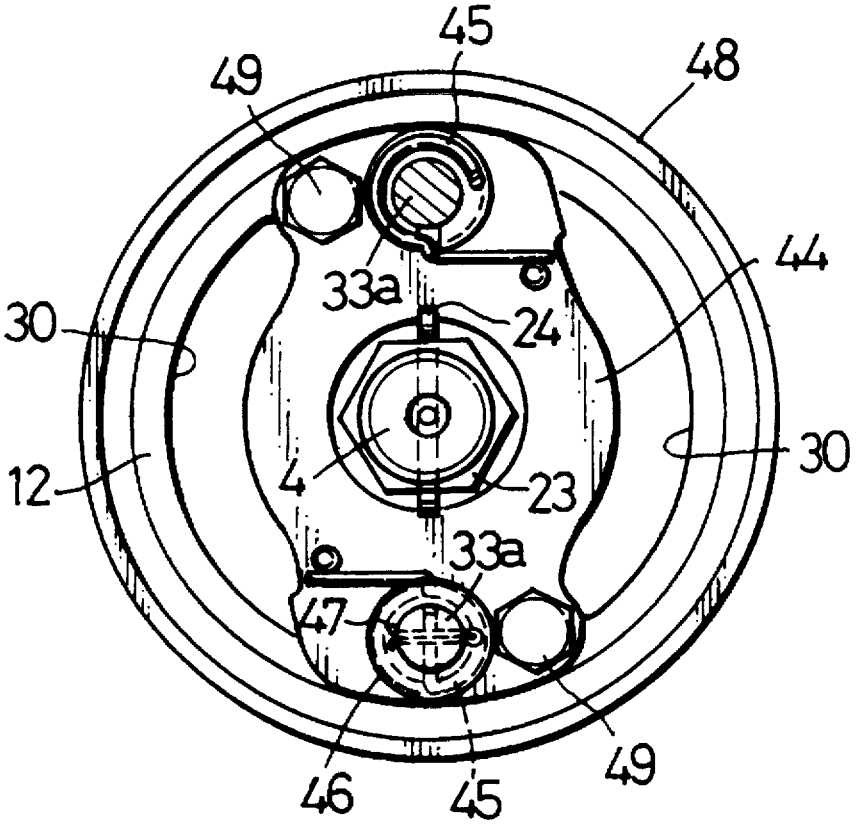
FIG. 5 is a sectional view taken along a line 5—5 in FIG. 2.

Referring to FIGS. 2 and 4, a synchronizer 40 is mounted at a rear portion of the propeller boss 12 for synchronously operating the pair of variable blades 32*m*. The synchronizer 40 includes a synchronizing pin 41 projecting from the outer peripheral surface of each blade 32 at its rear end, and a synchronizing ring 42 rotatably carried on the outer peripheral surface of the collar 21. Projection ends of the pair of synchronizing pins 41 are engaged in a pair of U-shaped connecting grooves 43 provided in outer peripheral surfaces of the synchronizing rings 42, respectively. Thus, the blade shafts 33 can be synchronously rotated in such a manner that the rotational angles are restricted with respect to each other through the respective synchronizing pins 41 and the common synchronizing ring 42.

Each of the blade shafts 33 includes a smaller-diameter shaft portion 33*a* extending rearwardly with an annular stepped portion 33*b* provided therein. A common retaining plate 44 is fitted over the smaller-diameter shaft portions 33*a* to abut against the stepped portion 33*b* and a rear end face of the propeller boss 12, and a return spring 45, a washer 46 receiving a rear end of the return spring 45 and a slip-off preventing pin 47 receiving a rear surface of the washer 46 are mounted on each of the smaller-diameter shaft portions 33*a*. The retaining plate 44 is secured to the rear end face of the propeller boss 12 by a bolt 49 (see FIG. 5).

The return spring 45 includes a torsion coil spring and is locked at its opposite ends on the retaining plate 44 and the smaller-diameter shaft portion 33*a*, respectively to normally bias each of the blade shafts 33 toward the above-described closed position A.

A diffuser pipe 48 increased in diameter toward its rear portion is integrally connected to the rear end of the propeller boss 12 to cover the smaller-diameter shaft portions 33*a*.

The operation of this embodiment will be described below. When the propeller shaft 4 is driven in a direction F of forward movement through the forward and backward gear mechanism 3, the propeller 5 is driven in rotation by the driving torque of the propeller shaft 4. The driving torque of the propeller shaft 4 is transmitted through the sleeve 18 to the propeller boss 12 and hence, the stationary and variable blades 32*f* and 32*m* are rotated along with the propeller boss 12 to generate a thrust force.

In a low-speed rotation range for the propeller 5, the variable blade 32*m* is retained at the closed position A by a force of the return spring 45 and a resisting force of water to maintain the propeller diameter at the minimum value $D_1$ which is smaller than the propeller diameter provided by the stationary blade 32*f*, thereby providing a low propeller efficiency of the variable blade 32*m*. Therefore, the total propeller efficiency of both the stationary and variable blades 32*f* and 32*m* is decreased and hence, the speed of variation in thrust force generated with a variation in rotational speed of the propeller 5 is reduced, leading to an enhanced low-speed operability of the boat. Thus, it is possible to easily conduct a trawling or the like.

In this case, particularly when the variable and stationary blades 32*m* and 32*f* are at least partially superposed on each other, the performances of the blades 32*m* and 32*f* interfere with each other and thus, the total propeller efficiency can be reduced, leading to a further improved low-speed operability.

Thereafter, when the rotational speed of the propeller boss 5 is increased to exceed a given value, the variable blades 32*m* are opened to positions where the centrifugal force applied to the variable blades 32*m* is balanced with the resisting force of water and the repulsion force of the return spring 45. When the rotational speed of the propeller boss 5 enters a predetermined high-speed rotation range, the variable blades 32*m* are turned to their opened positions where the propeller diameter reaches the maximum value $D_2$ substantially equivalent to the propeller diameter of the stationary blades 32*f*. This provides an enhanced propeller efficiency of the variable blades 32*m*, leading to a maximum total propeller efficiency. Thus, a high output performance is exhibited to enable a high-speed cruising.

During this time, the variable blades 32*m* are being operated in operative association with each other by the synchronizer 40, as described above and therefore, the variability in opening angle due to a difference between the centrifugal forces applied to the variable blades 32*m*, the resisting force of water and other external factors can be eliminated, whereby the performance of the propeller 5 is always stabilized.

The blade shaft 33 supporting the variable blades 32*m* is accommodated in the recess 26 in the propeller boss 12 so as not to protrude to the outside and hence, it is possible to prevent an increase in resistance of water by the blade shaft 33. Moreover, the blade shaft 33 is supported at its opposite ends in the bearing holes 28 and 29 in the opposite end walls of the recess 28 and hence, the variable blades 32*m* can be firmly supported.

An exhaust gas from the engine (not shown) is discharged into the hollow 1*a* in the propeller assembly body 1 and then through the exhaust outlet 13 in the bearing holder 10 into the exhaust gas distribution chamber 31 in the propeller boss 12. Then, the exhaust gas is diverted from the exhaust gas distribution chamber 31 into the two exhaust passages 30 and discharged into water. The exhaust passages 30 are provided in the propeller boss 12 in correspondence to the positions of the stationary blades 32*f*, as described above. Therefore, the exhaust passage can be formed into a larger sectional area without being obstructed by the blade shafts 33 and without forming the propeller boss 12 into a particularly large diameter, thereby avoiding an increase in resistance to the exhaust gas.

A second embodiment of the present invention will now be described with reference to FIGS. 6 to 11, wherein the same structural portions or components as in the previously described embodiment are designated by like reference characters and the description of them is omitted.

Figure 6:
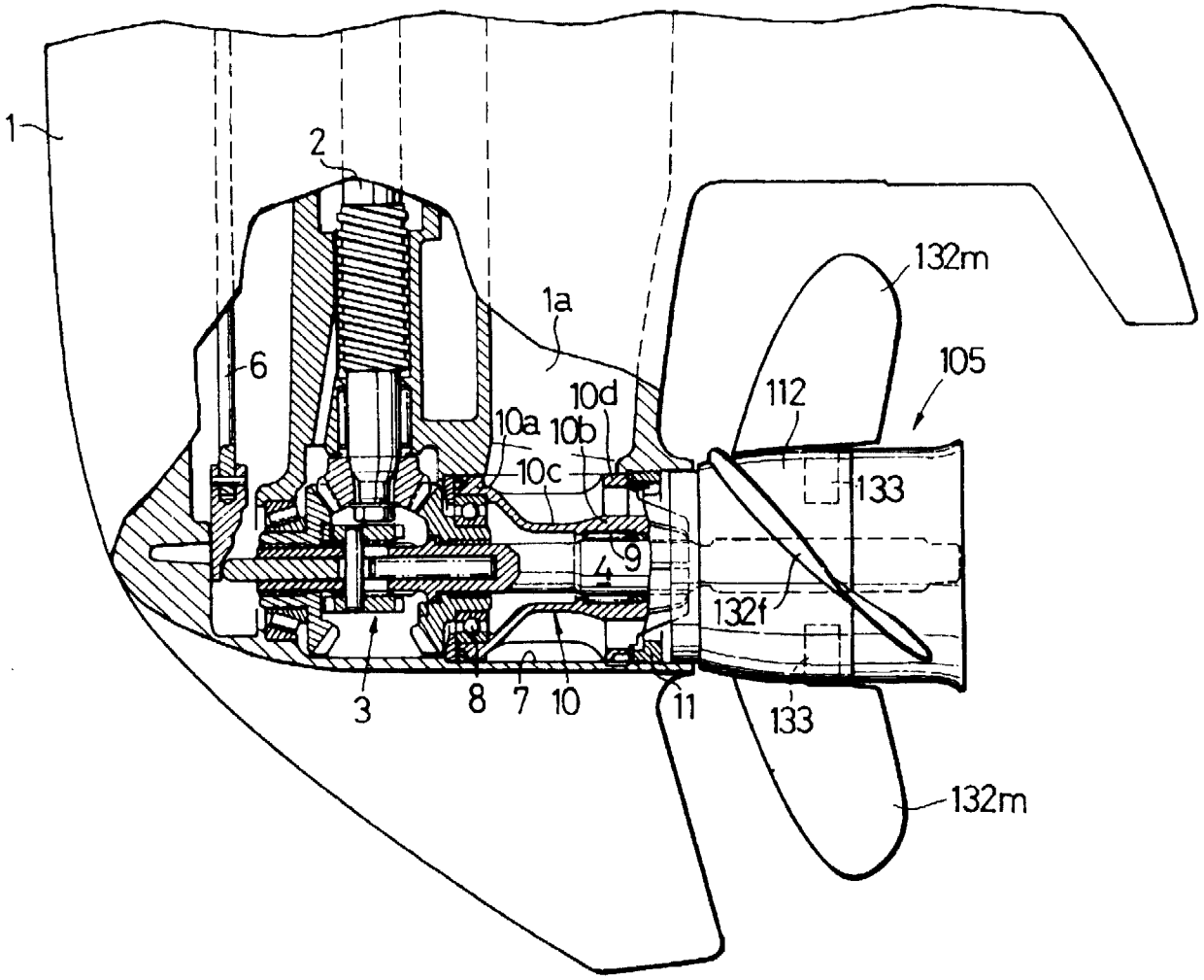
FIG. 6 is a partially vertical sectional side view of an essential portion of a propeller assembly including a propeller according to a second embodiment of the present invention.
Figure 7:
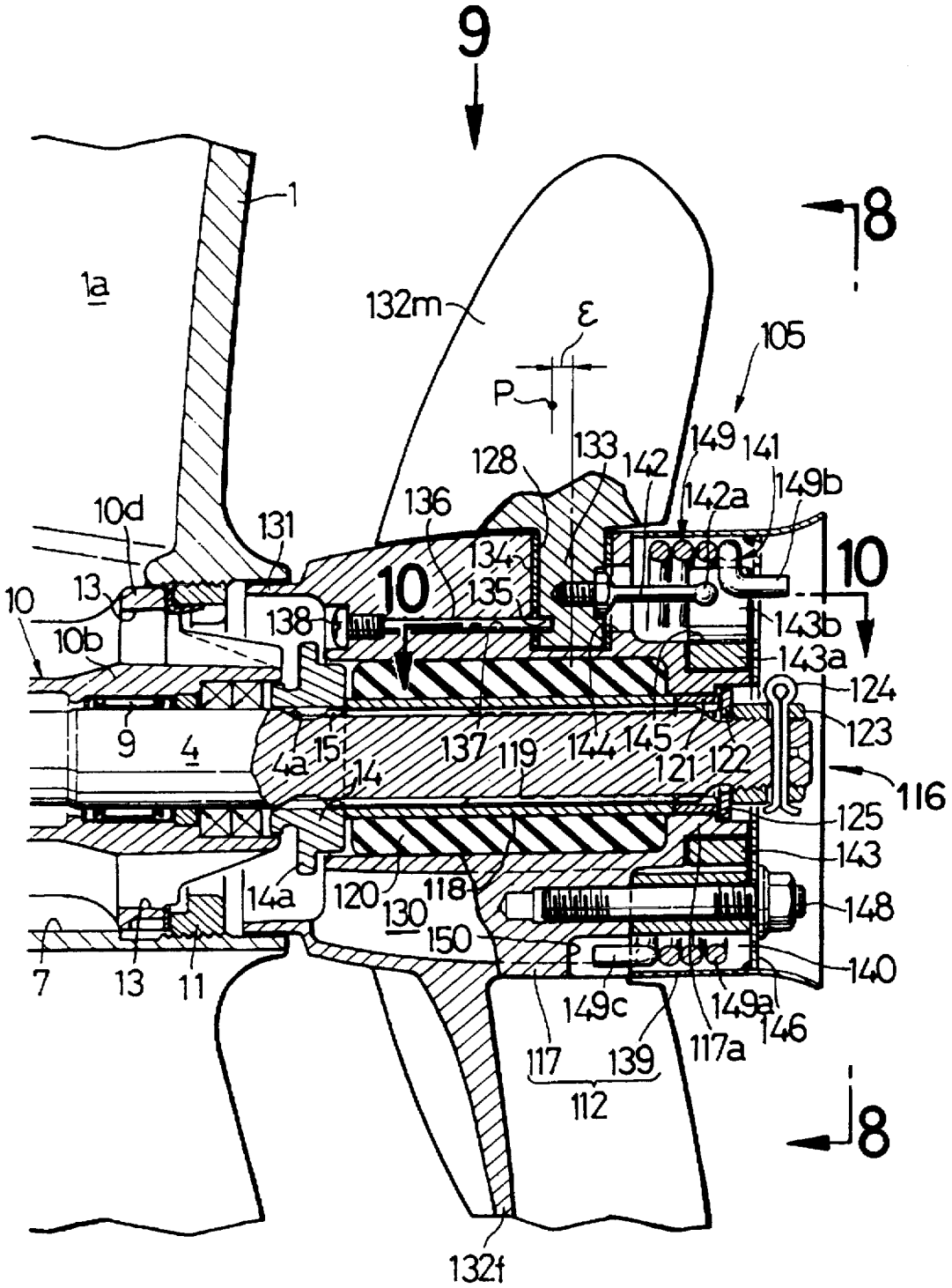
FIG. 7 is an enlarged vertical sectional view (taken along a line 7—7 in FIG. 8) of the essential portion shown in FIG. 6.

Referring to FIGS. 6 and 7, a propeller 105 in accordance with the second embodiment of the present invention is mounted on a propeller shaft 4. More specifically, in back of a thrust ring 14, a boss body 117 of a propeller boss 112 is connected to the propeller shaft 4 through a torque limiting device 116. The torque limiting device 116 and the boss body 117 are disposed in such a manner that they are superposed on each other concentrically about the propeller shaft 4.

The torque limiting device 116 includes a sleeve 118 detachably spline-fitted over the propeller shaft 4, and a rubber damper 120 baked to an outer peripheral surface of the sleeve 118 and press-fitted to an inner peripheral surface of the boss body 117. Thus, the rubber damper 120 is connected to the boss body 117 with a predetermined frictional force, such that when the rubber damper 120 undergoes a rotative torque of a predetermined value or more, a slipping is produced between the rubber damper 120 and the boss body 117.

An extended collar 121 is spline-fitted over the propeller shaft 4 to abut against a rear end of the sleeve 118, and a nut 123 is threadedly mounted at a rear end of the propeller shaft 4 for retaining a rear end of the extended collar 121 with a thrust washer interposed between the nut 123 and the extended collar 121 and having a diameter larger than that of the extended collar 121. A locking split pin 124 is inserted into the nut 123 and the propeller shaft 4. The extended collar 121 may be integral with the sleeve 118.

The boss body 117 includes a positioning boss **117*a* which protrudes rearwardly from an end wall covering a rear end of the rubber damper 120 and which is rotatably fitted to the extended collar 121, whereby the concentric position of the boss body 117 relative to the propeller shaft 4 is maintained. The positioning boss 117*a* is formed into a cylindrical shape to surround the thrust washer 122, and has a shoulder 125 provided on its inner peripheral surface in an opposed relation to a front surface of the thrust washer 122, such that a rearward thrust applied to the boss body 117 is received by the thrust washer 122 through the shoulder 125. In this case, a flange is formed around an outer periphery of the extended collar 121 at its rear end and may be disposed to abut against the shoulder 125**.

A front end face of the boss body 117 is opposed to a flange **14*a* formed around an outer periphery of the thrust ring 14, such that a forward thrust applied to the boss body 117 is received by the flange 14*a***.

Figure 8:
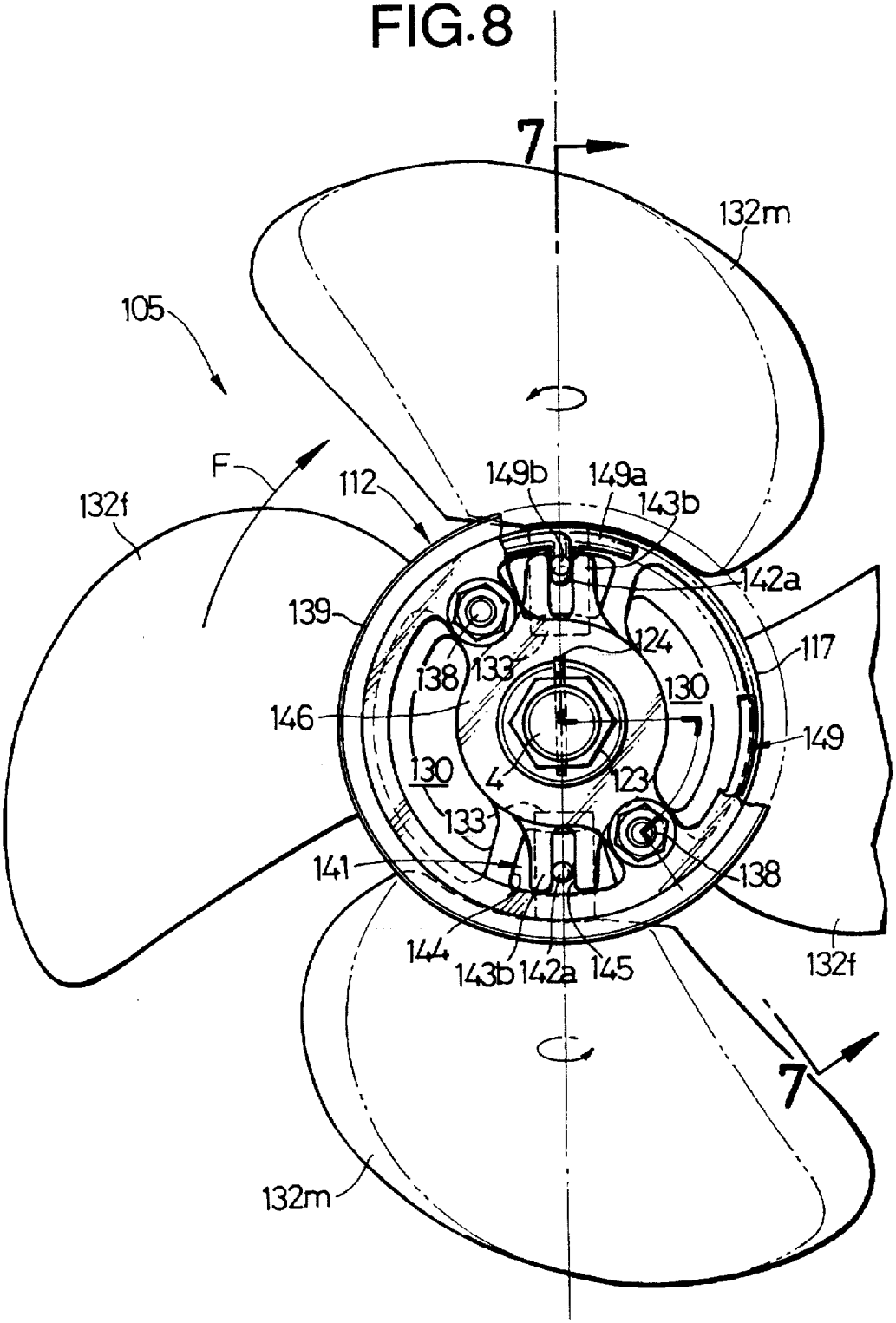
FIG. 8 is a view taken in a direction of an arrow 8 in FIG. 7.

Referring to FIGS. 7 and 8, stationary blades **132*f* and variable blades 132*m* are provided on the boss body 117 at circumferentially equal distances and arranged on a diametrical line of the boss body 117 to form a pair, respectively. The stationary blades 132*f* are formed integrally with the boss body 117, and the variable blades 132*m* are pivotally supported through a blade shaft 133**, such that the pitch thereof can be varied.

More specifically, provided in the boss body 117 are a pair of bearing holes 128 which extend radially between the pair of stationary blades **132*f* and open into an outer peripheral surface of the boss body 117, a pair of exhaust passages 130 which are axially passed through the boss body 117 at locations corresponding to the stationary blades 132, and an annular cylindrical portion 31 permitting the exhaust passages 130 to communicate with the exhaust outlet 13 at a front end of the boss body 117**.

A blade shaft 133 is integrally formed at a base end of the variable blade **132*m* and rotatably carried in each of the bearing holes 128 with a bush 134 made of a synthetic resin interposed therebetween, such that the pitch of the variable blades 132*m* is varied by the angular displacement of the blade shaft 133**.

Figure 10:
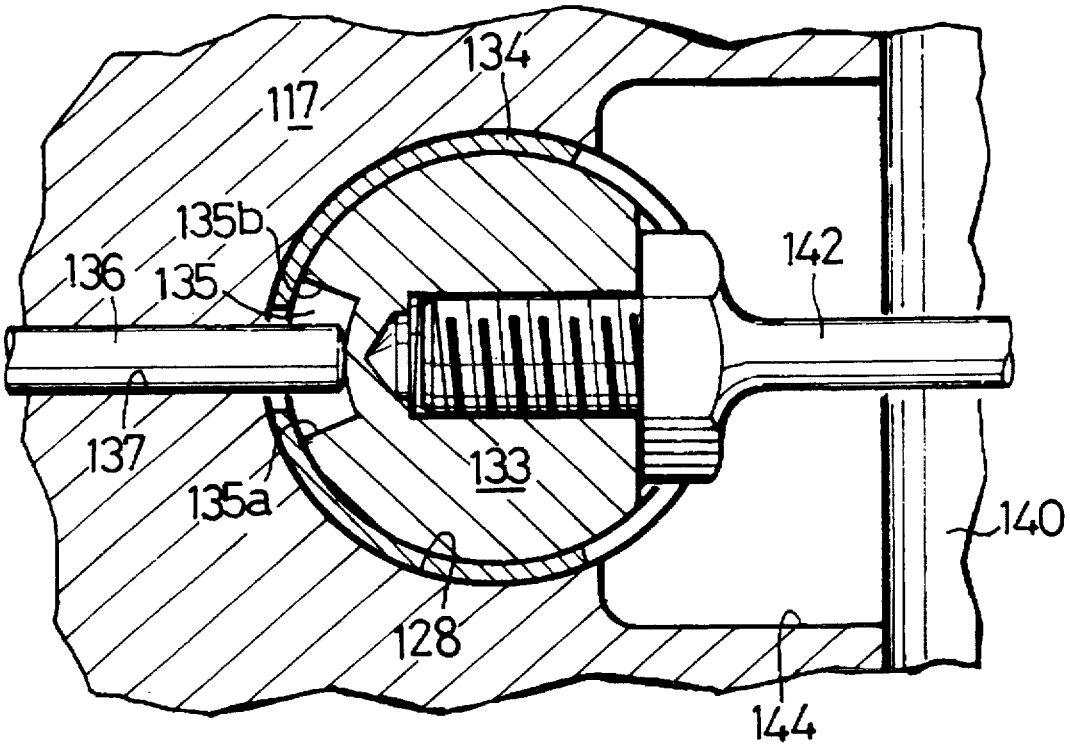
FIG. 10 is an enlarged vertical sectional view taken along a line 10—10 in FIG. 7.

Referring also to FIG. 10, an arcuate guide groove 135 is formed around an outer periphery of the blade shaft 133 at its tip end, and a limiting pin 136 is supported in the boss body 117 to engage the guide groove 135. This engagement prevents the slip-off of the blade shaft 133 from the bearing hole 128, and minimum- and maximum-pitch positions of the variable blades **132*m* are limited by the abutment of the limiting pin 136 against one end wall 135*a* and the other end wall 135*b* of the guide groove 135**.

The maximum pitch of the variable blades **132*m* and the pitch of the stationary blades 132*f* are set substantially equal to each other. The limiting pin 136 is inserted into a pin hole 137 which extends from a front surface of the boss body 117 to reach the bearing hole 128. In order to prevent the slip-off of the limiting pin 136, a machine screw 138 is threadedly inserted into the boss body 117 to occlude the pin hole 137**.

Figure 11:
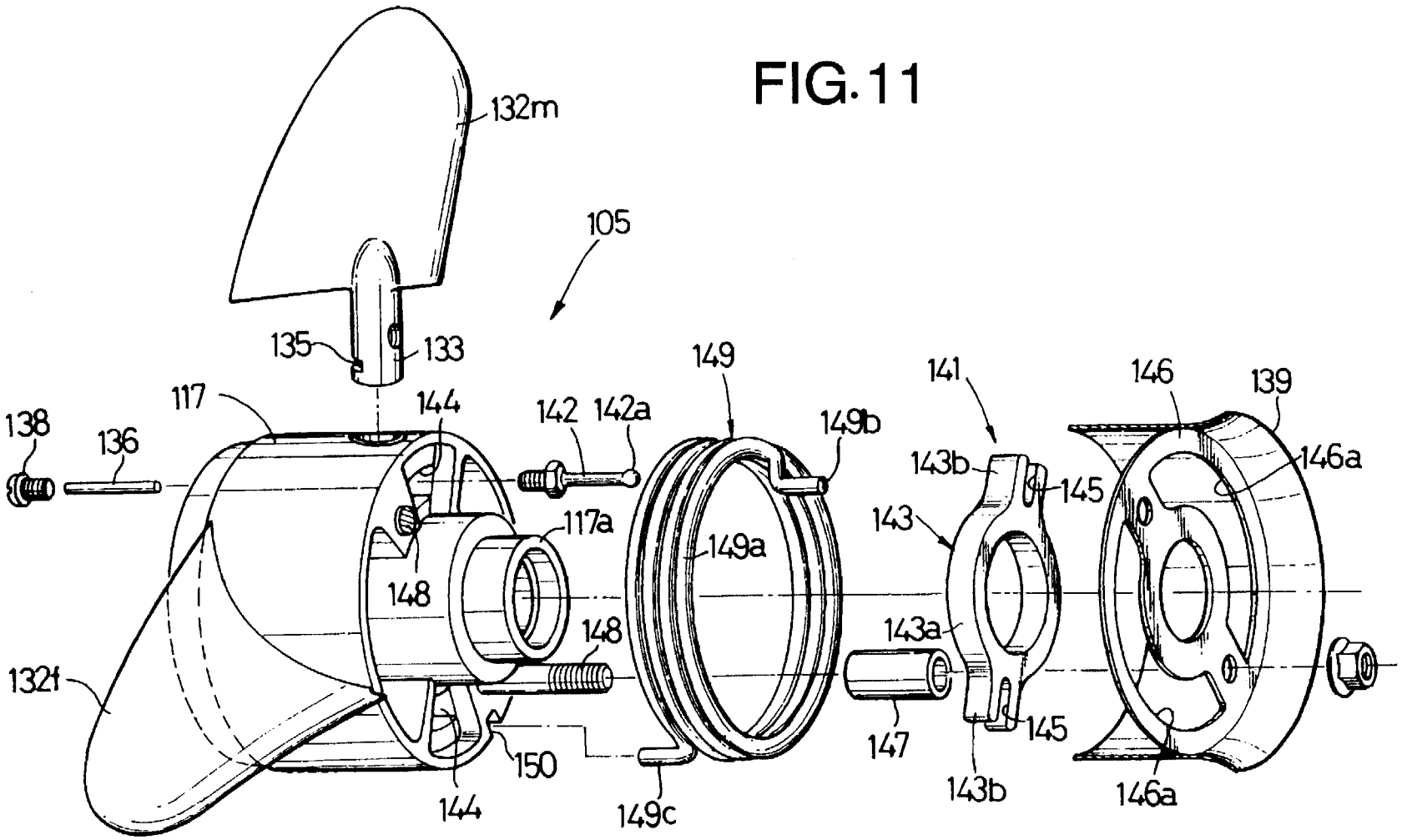
FIG. 11 is an exploded perspective view of the essential portion of the propeller.

As shown in FIGS. 7 and 11, the propeller boss 112 includes a diffuser pipe 139 of a small wall thickness fitted to a rear end of the boss body 117 such that their outer peripheral surfaces are continuous to each other. A mounting plate 146 is welded to an inner peripheral wall of the diffuser pipe 139 and fastened to a rear end face of the boss body 117 by a bolt 148 with a distance collar 147 sandwiched therebetween. The mounting plate 146 has exhaust bores **146*a* provided therein and aligned with the exhaust passages 130**.

Referring again to FIGS. 7, 8 and 11, a synchronizer chamber 140 is defined in the diffuser pipe 139 by a rear surface of the boss body 117 and the mounting plate 146, and a synchronizer 141 is accommodated in the synchronizer chamber 140 for synchronizing the changes in pitches of the pair of variable blades **132*m***.

The synchronizer 141 includes synchronizing pins 142 which are screwed into the blade shafts 133 of the respective variable blades **132*m* to protrude from rear surfaces of the blade shafts 133, and a single synchronizing ring 143 which is rotatably carried on an outer peripheral surface of the positioning boss 117*a* to engage the synchronizing pins 142. Each of the synchronizing pins 142 has a tip end protruding through a through-hole 144 of a larger diameter into the synchronizer chamber 140. Such tip end is formed into a spherical expanded end. The synchronizing ring 143 includes a ring portion 143*a* which is formed into a small wall thickness so as not to occlude the exhaust passages 130, and a pair of arm portions 143*b* which protrudes from an outer periphery of the ring portion 143*a* toward between the two exhaust passages 130. The expanded ends 142*a* of the pair of the synchronizing pins 142 is oscilatably engaged into radial engage grooves 145 which are formed in the arm portions 143*b***, respectively.

Thus, if the synchronizing ring 143 is turned in a clockwise or counterclockwise direction as viewed in FIG. 8, the pair of synchronizing pins 142 are concurrently swung rightwardly or leftwardly, thereby turning the variable blades **132*m* through the blade shaft 133 in a pitch increasing or decreasing direction. The synchronizing ring 143 is biased in the pitch decreasing direction by a return spring 149. The return spring 149 is a torsion coil spring and has a coiled portion 149*a* disposed along the inner peripheral surface so as not to transverse the exhaust passages 130. Terminals 149*b* and 149*c* protruding from front and rear ends of the coiled portion 149*a* are each curved into a hook-like shape and locked in the engage groove 145 in one of the arm portion 143*b* of the synchronizing ring 143 and in a notch 150 (see FIGS. 7 and 11) in the outer periphery of the boss body 117**, respectively.

Figure 9:
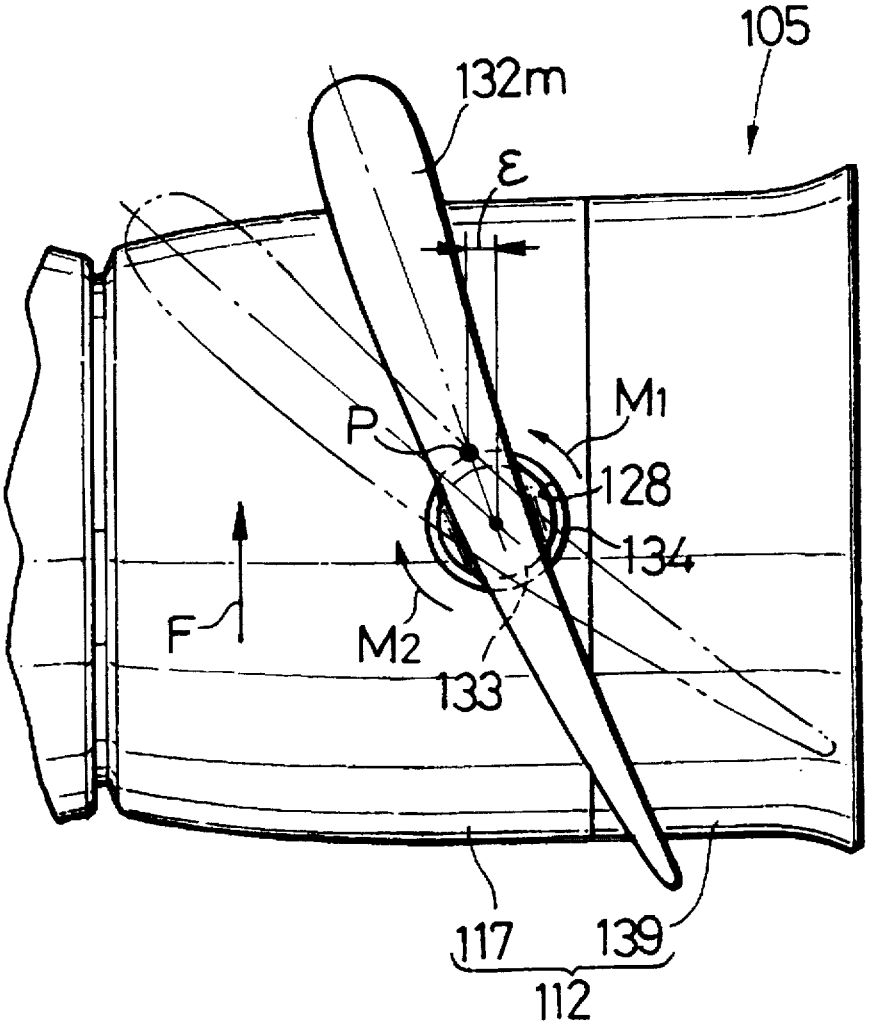
FIG. 9 is a view taken in a direction of an arrow 9 in FIG. 7.

Each of the variable blades **132*m* is formed such that the center of a resisting force of water produced during normal rotation of the propeller 105 (the normal rotation is indicated by an arrow F in FIGS. 8 and 4) is offset forwardly in an axial direction of the propeller shaft by a predetermined distance $\epsilon$, as shown in FIGS. 7 and 9**.

The operation of this embodiment will be described below. When the propeller shaft 4 is driven from the driving shaft 2 through the forward and backward gear mechanism 3, the driving torque is transmitted via the sleeve 118 and the rubber damper 120 to the propeller boss 112, thereby rotating the blades **132*f* and 132*m*** to generate a thrust force.

In a low-speed rotation range for the propeller 105, the resisting force of water concentrated on the center of the resisting force of the variable blades 132*m* is relatively small and hence, the variable blades 132*m* are retained at the minimum-pitch positions by a preset load of the return spring 149 through the synchronizer 141. Accordingly, even if the stationary blades 132 are of a large pitch, a total thrust force generated by all the blades 132*f* and 132*m* is relatively small and hence, the movement of the boat toward and away from a shore and a trawling can be easily achieved.

Thereafter, if the rotational speed of the propeller 105 is increased, the resisting force of water concentrated on the center of the resisting force of the variable blades 132*m* is increased. If the moment $M_1$ provided by such resisting force of water in the direction to increase the pitch of the variable blades 132*m* exceeds the moment $M_2$ provided by the load of the return spring 149 in the direction to decrease the pitch of the variable blades 132*m*, the variable blades 132*m* are angularly displaced in the pitch increasing direction. When the moments $M_1$ and $M_2$ are balanced with each other, the variable blades 132*m* are stabilized. However, if the rotational speed of the propeller 105 enters a high-sped rotation range, the variable blades 132*m* are urged to the maximum-pitch positions by the resisting force of water, where the pitch of the variable blades 132*m* is equal to that of the stationary blades 132*f*. Thus, a large total thrust force is generated by all the blades 132*f* and 132*m*, thereby enabling a high-speed cruising of the boat.

Since the pair of variable blades 132*m* are operatively associated with each other by the synchronizer 141, the variation in their pitches can be eliminated irrespective of a change in external conditions for the variable blades 132*m*, thereby providing a stabilized propeller performance.

When an obstacle such as a reef collides against the blades 132*f* and 132*m* during cruising of the boat, a shearing deformation is produced in the rubber damper 120 by an impact force of such collision, or a slipping is produced between the rubber damper 120 and the boss body 117, thereby making it possible to protect various portion of the propeller as well as a power transmitting system from an excessive load.

When an exhaust gas from the engine (not shown) is discharged through the exhaust outlet 12 in the bearing holder 10 into the cylindrical portion 131 of the boss body 117, the exhaust gas is diverted from the cylindrical portion 131 into the two exhaust passages 130 and discharged sequentially through the synchronizer chamber 140 and the exhaust bores 146*a* in the mounting plate 146, i.e., through the inside of the diffuser pipe 139 into water. In this case, since the exhaust passages 130 are provided in the boss body 117 in correspondence to the positions of the stationary blades 132*f*, the exhaust passage 130 can be formed into a large sectional area without being obstructed by the blade shafts 133 of the variable blades 132*m* and without forming the propeller boss 12 into a particularly large diameter, thereby decreasing the resistance to the exhaust gas.

Although the number of stationary and variable blades 32*f*, 32*m*, 132*f*, 132*m* used is not limited in the embodiments, it is desirable that a plurality of the blades 32*f*, 32*m*, 132*f*, 132*m* are disposed at equal distances in a circumferential direction of the propeller boss 112.

What is claimed is:

1. A propeller for a boat, comprising:

a propeller boss connected to a propeller shaft;

a stationary blade integrally formed on said propeller boss;

a variable blade pivotally supported on said propeller boss through a blade shaft, such that a diameter or pitch of said variable blade is increased in accordance with an increase in rotation speed of said propeller; and an exhaust passage for an engine exhaust gas provided in said propeller boss to axially pass through said boss at a location corresponding to said stationary blade.

2. A propeller for a boat according to claim 1, wherein said variable blade is openably and closably supported on said propeller boss through said blade shaft, such that the propeller diameter is increased and decreased in accordance with an increase and a decrease in centrifugal force.

3. A propeller for a boat according to claim 1 or 2, wherein the maximum propeller diameter of said variable blade is set substantially equal to the propeller diameter of said stationary blade.

4. A propeller for a boat according to claim 3, wherein said variable blade is formed such that when said variable blade is closed into a minimum propeller diameter position, at least a portion of said variable blade is superposed on said stationary blade.

5. A propeller for a boat according to claim 1, wherein the maximum pitch of said variable blade which is variable in pitch and the pitch of the stationary blade are substantially equal to each other.

6. A propeller for a boat according to claim 1 or 5, wherein said variable blade is formed such that the center of a resisting force of water generated during normal rotation of said propeller is offset from the center of said blade shaft forwardly in an axial direction of said propeller shaft by a predetermined distance, and said propeller further includes a return spring connected to said variable blade for biasing said variable blade in a pitch decreasing direction.

7. A propeller for a boat according to claim 1, 2, or 5, wherein a plurality of said variable blades are pivotally supported on said propeller boss and operatively associated with one another through a synchronizer in order to synchronize the changes in their propeller diameters or pitches.

* * * * *